US007471165B2

(12) United States Patent
Asamura et al.

(10) Patent No.: US 7,471,165 B2
(45) Date of Patent: Dec. 30, 2008

(54) HIGH-FREQUENCY BALUN

(75) Inventors: Fumio Asamura, Saitama (JP); Kenji Kawahata, Saitama (JP); Katsuaki Sakamoto, Saitama (JP)

(73) Assignee: Nihon Dempa Kogyo Co. Ltd., Tokyo (JP)

( * ) Notice: Subject to any disclaimer, the term of this patent is extended or adjusted under 35 U.S.C. 154(b) by 287 days.

(21) Appl. No.: 11/480,020

(22) Filed: Jun. 30, 2006

(65) Prior Publication Data

US 2007/0001779 A1 Jan. 4, 2007

(30) Foreign Application Priority Data

Jul. 1, 2005 (JP) ..... 2005-194302

(51) Int. Cl.
*H01P 5/10* (2006.01)
*H01P 3/08* (2006.01)
*H01P 5/12* (2006.01)

(52) U.S. Cl. ..... 333/26; 333/246

(58) Field of Classification Search ..... 333/25, 333/26, 246
See application file for complete search history.

(56) References Cited

U.S. PATENT DOCUMENTS 4,882,553 A * 11/1989 Davies et al. ..... 333/26
6,917,332 B2 7/2005 Aikawa et al. ..... 343/700 MS

FOREIGN PATENT DOCUMENTS

JP 2002-232215 8/2002

* cited by examiner

*Primary Examiner*—Dean O Takaoka
(74) *Attorney, Agent, or Firm*—Muirhead and Saturnelli, LLC

(57) ABSTRACT

In a balun for mutually converting an unbalanced line for unbalanced input/output and a balanced line for balanced input/output, the unbalanced line and the balanced line are microstrip lines including a signal line arranged on one main surface of a substrate and a ground conductor arranged on the other main surface of the substrate. The balun further includes a slot line formed by a aperture line arranged in the ground conductor in the other main surface. The microstrip line as the unbalanced line includes one end portion used as an input/output end and the other end portion that traverses the slot line, electromagnetically couples to the slot line, and functions as an electric short-circuited end. The central portion of the microstrip line as the balanced line traverses the slot line and electromagnetically couples to the slot line. Both ends of this microstrip line serves as the input/output ends.

5 Claims, 6 Drawing Sheets

HIGH-FREQUENCY BALUN

BACKGROUND OF THE INVENTION

1. Field of the Invention

The present invention relates to a balun used to mutually convert a unbalanced transmission line and a balanced transmission line, and in particular relates to a balun that is suitable for use in a high-frequency band, such as a microwave band and that attains a wider bandwidth.

2. Description of the Related Art

A balun is known as a transformer for converting from an unbalanced transmission line to a balanced transmission line and vice versa, and is used, for example, in an input/output end of a repeater in a communication system. Various baluns are known, and one of those is a high-frequency balun using a microstrip line (MSL) coupling line, known as an unbalanced high-frequency transmission line. In recent years, in optical communication systems or the like, information has been transmitted by using UWB (Ultra Wide Band) as a frequency band, for example, a frequency band from 3.1 to 10.6 GHz, and with this situation, a wider bandwidth is required for a high-frequency balun.

FIG. 1A shows a conventional high-frequency balun formed by a microstrip line coupling line, and FIG. 1B shows a cross-sectional view taken along a line A-A in FIG. 1A. The high-frequency balun includes unbalanced microstrip line 1 used for unbalanced input/output, and a pair of microstrip lines 2, 3 used for balanced input/output. In microstrip lines 1 to 3, a high-frequency wave component travels or propagates by electromagnetic fields between signal lines 1*a*, 2*a*, 3*a* arranged in one main surface of substrate 4 made of a dielectric material and ground conductor 5 formed over the entirety of the other main surface of substrate 4.

Unbalanced microstrip line 1 is formed, for example, by extending signal line 1*a* from the left end of substrate 4 in the horizontal direction in drawings. Balanced microstrip lines 2, 3 are formed, for example, by extending a pair of signal lines 2*a*, 3*a* from the lower end of substrate 4 to be close each other and to be parallel. Tip portions of signal lines 2*a*, 3*a* are bent in directions that are mutually reversed, and each of signal lines 2*a*, 3*a* extends along unbalanced microstrip line 1 (i.e., signal line 1*a*) in parallel. Each tip end of bent portion 2*x*, 3*x* in unbalanced microstrip lines 2, 3 (i.e., signal lines 2*a*, 3*a*) is electrically connected to ground conductor 5 in the other main surface by electrode through-connection 6, such as a via-hole and a through-hole. Then, each bent portion 2*x*, 3*x* has an electric length of $\lambda/4$ relative to wavelength $\lambda$ corresponding to transmission frequency (central frequency) $f_0$, which is a high frequency. In this case, the tip end of each of bent portion 2*x*, 3*x* is an electric short-circuit end, and each bending point function as an electric open end.

In a balun like this, balanced outputs from amplifier 7 in mutually opposite-phase, using a ground potential as a reference, are applied to balanced microstrip lines 2, 3 (i.e., signal lines 2, 3) of the high-frequency balun. Then, the balanced outputs in mutually opposite-phase travel in balanced microstrip lines 2, 3, using ground potential 5 as a reference potential. Since tip end of each of bent portions 2*x*, 3*x* is an electric short-circuited ends and each bending point functions as an electric open end, standing waves W1, W2 in mutually opposite-phase with electric lengths of $\lambda/4$ are generated in both bent portions viewed from each bending point such that the bending points are maximum voltage displacement points and the tip end points are minimum voltage displacement points (i.e., zero voltage points). Incidentally, amplifier 7 further includes an unbalanced input terminal, a power source terminal connecting to power source Vcc, and a ground terminal connecting to a ground potential point.

Then, since each bent portion 2*x*, 3*x* of balanced microstrip lines 2, 3 are mutually close to unbalanced microstrip line 1, both are electromagnetically coupled. Therefore, standing wave W of electric length of $\lambda/2$, which regards both ends as maximum voltage displacement points in mutually opposite-phase, is induced in unbalanced microstrip line 1, while center point P between bending points of balanced microstrip lines 2, 3 is approximately regarded as a reference point (i.e., null potential point). With this arrangement, in unbalanced microstrip line 1, the high-frequency wave component in unbalanced mode between signal line 1*a* and ground conductor 5 travels toward the left end side of unbalanced microstrip line 1, while the opening end of unbalanced microstrip line 1 (right end in FIG. 1A, maximum voltage displacement point) is regarded as a starting point. Then, for example, coaxial cable 8 is connected to unbalanced microstrip line 1, and the high-frequency wave is transmitted to coaxial cable 8 in unbalanced mode.

In this way, in the above high-frequency balun, each of bent portions 2*x*, 3*x* of balanced microstrip lines 2, 3 is set to a length of $\lambda/4$ relative to wavelength of $\lambda$ corresponding to transmission frequency $f_0$, and then a standing wave of $\lambda/2$ is generated. In other words, bent portions 2*x*, 3*x* are resonant with transmission frequency $f_0$ corresponding to standing wave of $\lambda/2$. Then, bent portions 2*x*, 3*x* are electromagnetically coupled to unbalanced microstrip line 1, and transmission frequency $f_0$ in unbalanced mode is obtained. Specifically, in the high-frequency balun using the microstrip line coupling line, the balanced mode is converted to the unbalanced mode and vice versa using resonant phenomenon, and transmission frequency $f_0$ is obtained. Therefore, as shown in FIG. 2, single peak characteristic (curve L) is obtained after conversion, while transmission frequency characteristic (curve K) having a linear property is provided before conversion, and there is a problem in that the band width of transmission frequency $f_0$ is narrowed.

Further, as shown in FIG. 3, when microstrip line 15 is merely branched in parallel, and one branch microstrip line 15*a* is made longer (or shorter) than another branch microstrip line 15*b* by $\lambda/2$ with respect to transmission frequency $f_0$, the high-frequency wave component in balanced mode in mutually opposite-phase can be obtained. However, in this case, since only transmission frequency $f_0$ corresponding to wavelength $\lambda$ is in opposite-phase, it causes a narrow band characteristic.

SUMMARY OF THE INVENTION

Accordingly, it is an object of the present invention to provide a high-frequency balun having a flat propagation characteristic across a wide band without losing the band width of the transmission frequency during the mutual-conversion between the balanced line and the unbalanced line.

According to the first aspect of the present invention, in a balun for mutually converting an unbalanced line for unbalanced input/output and a balanced line for balanced input/output, the unbalanced line and the balanced line are microstrip lines including a signal line arranged on one main surface of a substrate and a ground conductor arranged on the other main surface of the substrate. The balun further includes a slot line formed by an aperture line arranged in the ground conductor in the other main surface of the substrate. In this balun, a microstrip line as the unbalanced line includes a first end portion used as an input/output end and a second end portion that traverses or crosses the slot line, electromagnetically couples to the slot line, and functions as an electric short-circuited end. A center portion of a microstrip line as the balanced line traverses or crosses the slot line and electromagnetically couples to the slot line and both end sides of this microstrip line are used as input/output ends.

This high-frequency balun uses electromagnetic coupling by intersecting the microstrip line and the slot line (SL) through the substrate. When the tip portion of the slot line and the central point of the microstrip line are crossed and are electromagnetically coupled to each other, the high-frequency component is branched from the central point of the microstrip line to both end sides of the microstrip line in opposite-phase. For example, U.S. Pat. No. 6,917,332 discloses electromagnetic coupling like this.

According to this arrangement, first, the microstrip line as the unbalanced line is electromagnetically coupled to the slot line, and the high-frequency wave component travels from the microstrip line to the slot line. Then, the slot line is electromagnetically coupled to the microstrip line as the balanced line at the central portion of the microstrip line. Therefore, the high-frequency component branches from the central point of the microstrip line as the balanced line in opposite-phase and travels toward both ends of the microstrip line. Therefore, the unbalanced line can be converted to the balanced line. Needless to say, the balanced line can be converted to the unbalanced line. According to this arrangement, since the slot line is used, basically, the bandwidth of the transmission frequency can be made wider and the transmission characteristic within the passing band can be made flat.

In a balun like this, the second end portion of the microstrip line as the unbalanced line may traverse the slot line at one end side of the slot line and the center portion of the microstrip line as said balanced line may traverse the slot line at the other end side of the slot line. Also, in this arrangement, the high-frequency component from the microstrip line as the unbalanced line is electromagnetically coupled to the slot line, and the high-frequency component branches from the central point of the microstrip line as the balanced line to each end of the microstrip line in opposite-phase. Therefore, the unbalanced line and the balanced line can be mutually converted.

Also, the microstrip line as the unbalanced line may traverse the center portion of the slot line, the balanced line may include first and second microstrip lines which extend in mutually reverse directions viewed from the slot line, one end portion of the first microstrip line may traverse the slot line at one end side of the slot line and function as an electric short-circuited end, the other end portion of the first microstrip line may be the input/output end, one end portion of the second microstrip line may traverse the slot line at the other end side of the slot line and function as an electric short-circuited end, and the other end portion of the second microstrip line may be the input/output end. Also, in this arrangement, the high-frequency component from the microstrip line as the unbalanced line is electromagnetically coupled to the first and second microstrip lines as the balanced lines at both sides branched from the central portion of the slot line in-phase. Then, the high-frequency component is branched to the first and second microstrip lines as the balanced lines in opposite-phase. Finally, the high-frequency signal is branched from the central points of the first and second microstrip lines in opposite-phase, and this arrangement acts as a balun.

In the present invention, an end portion that functions as the electric short-circuited end of the microstrip line may project to provide an electric length of $\lambda/4$ from a traversing point (i.e., crossing point) to the slot line relative to a wavelength of $\lambda$ corresponding to a transmission frequency. With this arrangement, the energy conversion efficiency from the microstrip line to the slot line in the transmission frequency can be enhanced.

Alternatively, the end portion that functions as the electric short-circuited end of the microstrip line may be constructed by electrically connecting a signal line and a ground conductor of the microstrip line by an electrode through-connection such as a via-hole or through-hole. This arrangement provides an electric short-circuited end for wide frequency bands, there is no frequency selectivity, and therefore the bandwidth of the transmission frequency can be made wider.

In the balun according to the present invention, preferably, both ends of the slot line function as electric open ends. With this arrangement, the energy conversion efficiency from the microstrip line to the slot line can be enhanced.

The both end portions of the slot line may project to provide an electric length of $\lambda/4$ from a traversing point with the microstrip line relative to a wavelength of $\lambda$ corresponding to a transmission frequency. With this arrangement, the energy conversion efficiency can be enhanced.

Alternatively, viewed from a traversing point on the microstrip line, both end portions of the slot line that function as electric open ends are provided with broader hollows than a width of the slot line at a central portion of the slot line. With this arrangement, both ends of the slot line function as electric open ends for wide frequency bands, there is no frequency selectivity, and therefore the bandwidth of the transmission frequency can be made wider.

According to the second aspect of the present invention, a balun for mutually converting an unbalanced line for unbalanced input/output and a balanced line for balanced input/output, comprising first and second signal lines which are arranged on one main surface of a substrate and are adjacent and parallel, a ground conductor which is arranged in the other main surface of the substrate so as to be superimposed on one end side of each of the first and second signal lines, and an electrode through-connection which is arranged at one end of the second signal line and is electrically connected to the ground conductor, wherein one end side of the first signal line forms a microstrip line together with the ground conductor to provide the unbalanced line, and the other end sides of the first and second signal lines are regarded as the balanced lines.

This balun is configured while attention is paid to the microstrip line and the pair of balanced lines. In this arrangement, since the first and second signal lines share the ground conductor, for example, the high-frequency component in unbalanced mode to be input to one end side of the first signal line exists just like as the high-frequency source between the first and second signal lines, and the high-frequency components in-opposite phase each other are generated by electromagnetic coupling between the first and second signal lines. Therefore, the unbalanced line and the balanced line can be mutually converted.

In a balun like this, preferably, the other end sides of said first and second signal lines extend adjacently in parallel, and then extends in mutual-apart directions, and a ground conductor that is superimposed by the first and second signal lines extending in the mutually-apart directions is arranged on the other surface of the substrate to provide a microstrip line. With this arrangement, the balanced line formed from the microstrip lines in opposite-phase each other can be obtained.

DETAILED DESCRIPTION OF THE PREFERRED EMBODIMENTS

First Embodiment

Figure 1A:
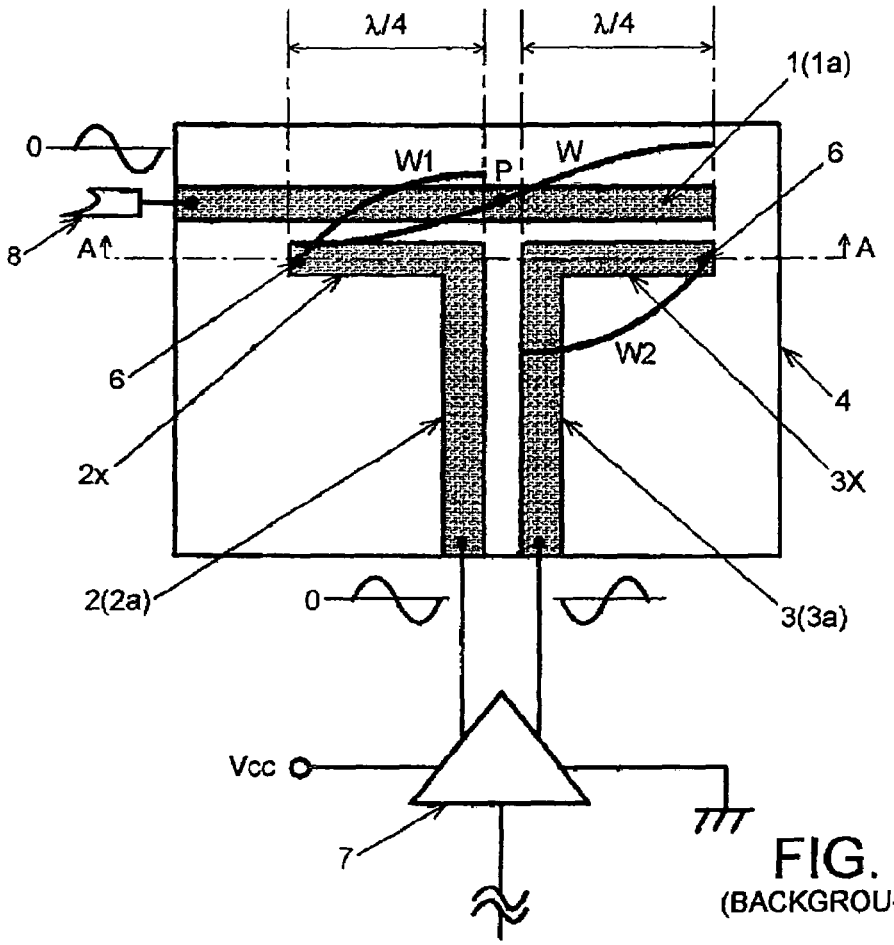
FIG. 1A (BACKGROUND ART)
FIG. 1A is a plan view showing a conventional high-frequency balun.
Figure 1B:
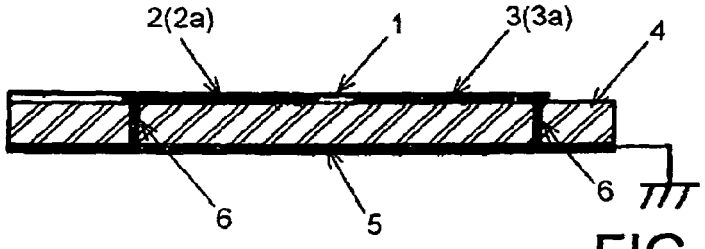
FIG. 1B (BACKGROUND ART)
FIG. 1B is a cross-sectional view taken along line A-A in FIG. 1A.
Figure 4A:
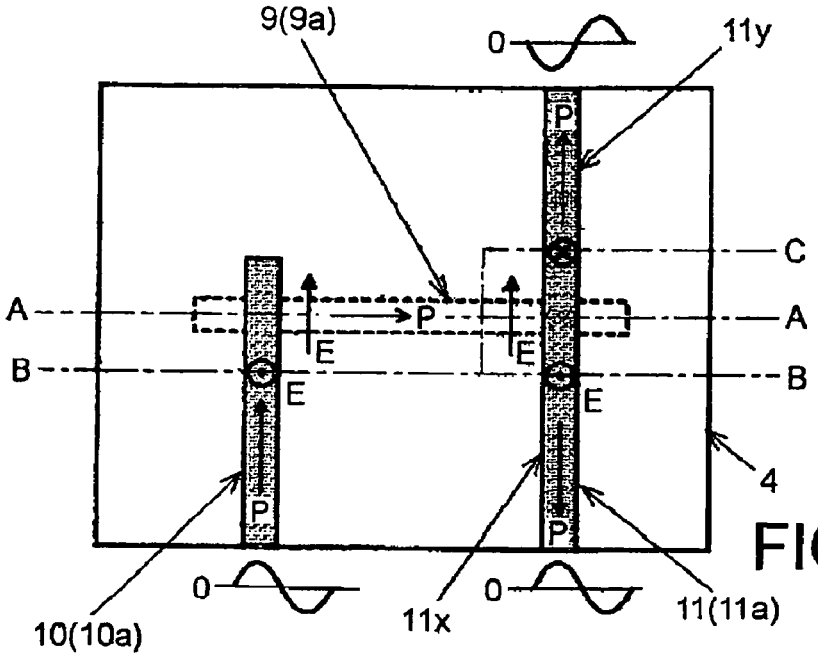
FIG. 4A is a plan view showing a high-frequency balun according to the first embodiment of the present invention.
Figure 4B:
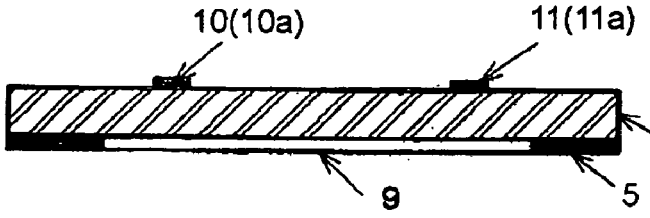
FIG. 4B is a cross-sectional view taken along line A-A in FIG. 4A.

FIGS. 4A and 4B show a high-frequency balun according to the first embodiment of the present invention. In FIGS. 4A and 4B, the same reference numerals are applied to the same elements as FIGS. 1A and 1B, and no redundant explanations are repeated.

Figure 5A:
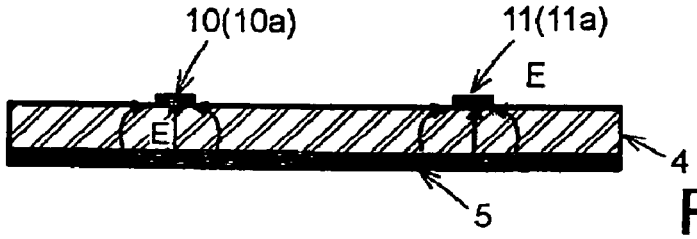
FIG. 5A is a view showing an electric filed direction distribution in the balun taken along line B-B in FIG. 4A.
Figure 5B:
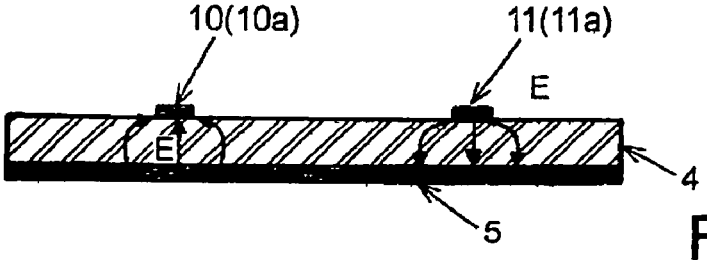
FIG. 5B is a view showing an electric filed direction distribution in the balun taken along line B-C in FIG. 4A.

A balun according to the first embodiment and baluns according to the second and third embodiments, which will be described later, are basically configured by using slot line 9 for converting a balanced line to an unbalanced line and vice versa. A balun according to the first embodiment includes: substrate 4 made of a dielectric material or the like; microstrip lines 10, 11 each having a signal lines formed in one main surface of substrate 4; ground conductor 5 formed on the whole of the other main surface of substrate 4; and slot line 9 arranged by forming an opening in ground conductor 5. Microstrip line 10 is a microstrip line of the unbalanced line for input/output in unbalanced mode. In this specification, we call microstrip line 10 an unbalanced microstrip line. Microstrip line 11 is provided for constituting the balanced line for input/output in balanced mode. In this specification, we call microstrip line 11 a balanced microstrip line. Slot line 9 for conversion is arranged in ground conductor 5 in the other main surface of substrate 4 as aperture line 9*a* in the horizontal direction in drawings, of which both ends (i.e., left and right directions in FIG. 4A) are closed. In slot line 9, the high-frequency component travels along aperture line 9 by an electric field and a magnetic filed generated by this electric field between ground conductor of both sides of aperture line 9*a*. FIGS. 5A and 5B respectively show electric field direction distributions in the balun taken along lines B-B and B-C in FIG. 4A. In FIG. 4A, symbol "⊙" represents an electric field upward from the other main surface to one main surface of substrate 4, and symbol "ⓧ" represents an electric field downward from one main surface to the other main surface of substrate 4.

Unbalanced microstrip line 10 extends from one end side (e.g., the lower end of substrate 4) to be an input/output end for the high-frequency components in unbalanced mode and traverses or crosses one end side of slot line 9 (the left end side of slot line 9 in FIG. 4A). The other end side of unbalanced microstrip line 10 (the upper end side in substrate 4) projects from the traversing point on slot line 9, with the electric length of approximately $\lambda/4$ while the wavelength corresponding to transmission frequency $f_0$ is set to $\lambda$, and therefore functions as an electric short-circuited end for components of transmission frequency $f_0$. Incidentally, the electric short-circuited point is the traversing point with slot line 9.

Balanced microstrip line 11 has both ends to be input/output ends for the high-frequency components in balanced mode. In FIG. 4A, the both ends are an upper end and a lower end of substrate 4, and balanced microstrip line 11 connects these both ends and extends linearly, and the central portion (center point) of microstrip line 11 traverses or crosses the other end side (the right end side of slot line 9 in FIG. 4A) of slot line 9. The end at the left side (in FIG. 4A) of slot line 9 projects from the traversing point of unbalanced microstrip line 10 by $\lambda/4$, the end at the right side of slot line 9 projects from the traversing point of unbalanced microstrip line 11 by $\lambda/4$, and both ends function as electric opening ends for transmission frequency $f_0$. Incidentally, the electric open point is the traversing point with microstrip line 10. In the following explanations, a lower portion from the traversing point of slot line 9 in unbalanced microstrip line 11 is regarded as balanced microstrip line 11*x* and an upper portion from the traversing point is regarded as balanced microstrip line 11*y*.

In a balun like this, for example, high-frequency wave component P of transmission frequency $f_0$ in unbalanced mode by a coaxial cable is applied to the lower end of unbalanced microstrip line 10. Then, high-frequency wave component P in unbalanced mode travels as it is and reaches the traversing point with slot line 9. Here, when a consideration is given to a case in that electric field E is upward from the other main surface to one main surface of substrate 4, that is, from ground conductor 5 to signal line 10*a* of unbalanced microstrip line 10, an electric field that crosses slot line 9 in a direction from the lower side to the upper side of slot line 9 and a magnetic field orthogonal to the electric field occur, in particular, at the right side of unbalanced microstrip line 10, as shown in FIGS. 4A, 5A and 5B. Therefore, with these electric and magnetic fields, the high-frequency component from unbalanced microstrip line 10 is converted to the high-frequency component in balanced mode in slot line 9. Then, the high-frequency component in balanced mode by slot line 9 travels on slot line 9 to the right side from the traversing point (crossing point) with unbalanced microstrip line 10. In this case, since the tip end portion of unbalanced microstrip line 10 function as an electric short-circuited end with respect to transmission frequency $f_0$, the traversing point of slot line 9 becomes a minimum voltage displacement point (i.e., null potential point) with respect to transmission frequency $f_0$. Also, since both end portion sides of slot line 9 project from the respective traversing points on microstrip lines 10, 11 by λ/4 and are electric open ends, the energy conversion efficiency from the microstrip line to the slot line is enhanced.

Then, the high-frequency wave component in balanced mode that travels in slot line 9 is converted into the high-frequency wave component in unbalanced mode by electromagnetic coupling to balanced microstrip line 11 that traverses slot line 9 at the right side of slot line 9. When electric field E across slot line 9 is directed from the lower side to the upper side, electric field E from the other main surface to one main surface of substrate 4 is generated in balanced microstrip line 11*x* that extends from the traversing point of slot line 9 to the lower side. Also, electric field E from one main surface to the other main surface, which is the opposite direction to the electric field in balanced microstrip line 11*x*, is generated in balanced microstrip line 11*y* that extends from the traversing point of slot line 9 to the upper side.

With this arrangement, high-frequency wave component P branches from the traversing point of slot line 9 in opposite-phase, provides a so-called serial opposite-phase branched structure, and travels in balanced microstrip lines 11*x*, 11*y* in the unbalanced mode. Therefore, at the upper and lower ends, that is, at output ends of balanced microstrip lines 11*x*, 11*y*, it is possible to obtain the high-frequency wave components in balanced mode in opposite-phase each other, while the ground potential is regarded as a reference. However, the high-frequency wave component propagates in unbalanced mode by the electromagnetic field between the signal line and ground conductor 5 in each of balanced microstrip lines 11*x*, 11*y* in itself.

Figure 6:
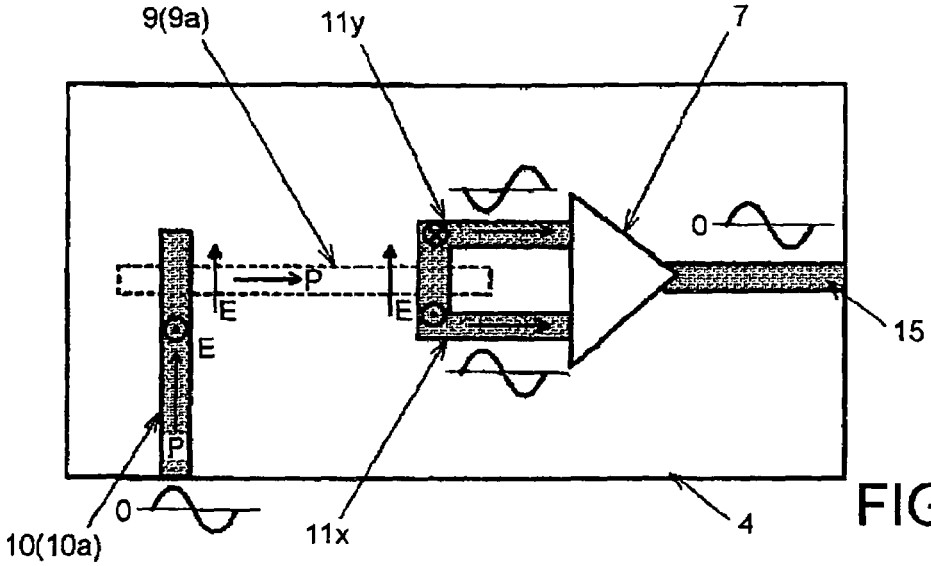
FIG. 6 is a plan view showing an application example of the balun shown in FIGS. 4A and 4B.

Then, when coaxial cables are respectively connected to both output ends of balanced microstrip line 11, each coaxial cable can transmit the high-frequency component in unbalanced mode in opposite-phase each other, and the high-frequency wave component can be transmitted in balanced mode as a whole. As shown in FIG. 6, balanced microstrip lines 11*x*, 11*y* are extended on substrate 4 and are connected to, for example, each input terminal of two-input amplifier 7, thereby facilitating balanced input easily. The ground terminal of amplifier 7 can be directly connected to ground conductor 5. Balanced microstrip lines 11*x*, 11*y* have the same line length, and the input in opposite-phase is maintained. Then, for example, when output from amplifier 7 is in unbalanced mode, the output thereof can be introduced through microstrip line 15 and can be transmitted by a coaxial cable.

Figure 2:
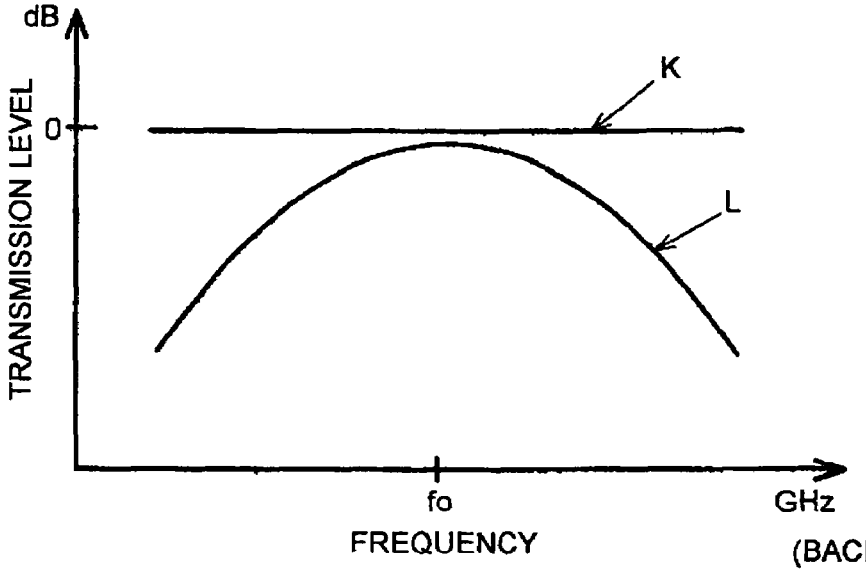
FIG. 2 (BACKGROUND ART)
FIG. 2 is a graph showing a transmission frequency characteristic of the conventional high-frequency balun.
Figure 3:
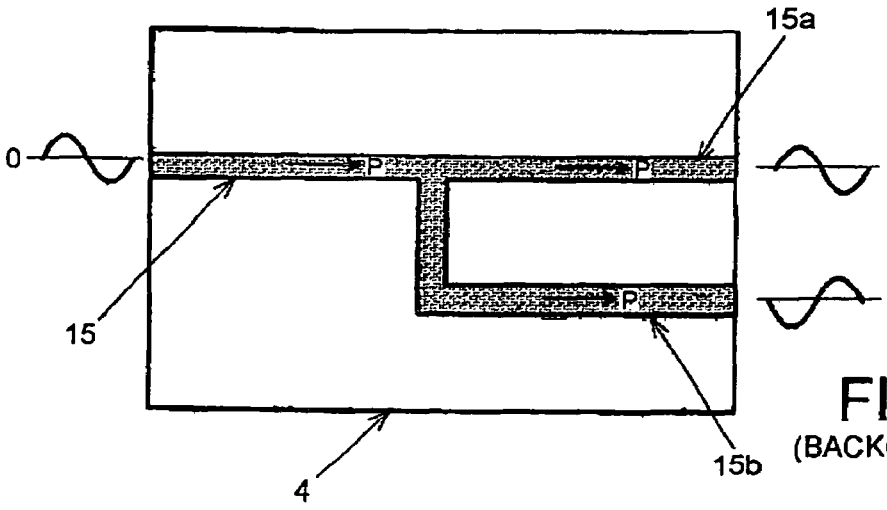
FIG. 3 (BACKGROUND ART)
FIG. 3 is a plan view showing another example of a conventional high-frequency balun.

According to this arrangement, by using unbalanced microstrip line 10, slot line 9, and balanced microstrip line 11, particularly, by an opposite-phase serial branch from slot line 9 to balanced microstrip line 11, high-frequency components in opposite phase each other can be obtained while propagations on microstrip lines are in unbalanced mode in itself, the high-frequency component in unbalanced mode can be converted into balanced mode. In this case, the end of slot line 9 projects from the traversing point of the microstrip line by λ/4 and provides an electric open end while the wavelength corresponding to transmission frequency $f_0$ is λ. Therefore, frequency selectivity occurs in the operation of the balun, however, because the slot line has a smaller Q value in the resonance characteristics than the microstrip line, a gentle frequency propagation characteristic is obtained. In the conventional balun using microstrip lines, as indicated by curve L in FIG. 2, it is possible to obtain a frequency propagation characteristic with a single peak characteristic while transmission frequency (center frequency) $f_0$ is regarded as the center. On the other hand, the balun according to the first embodiment shows a flat frequency propagation characteristic compared with the conventional balun.

Second Embodiment

Figure 7A:
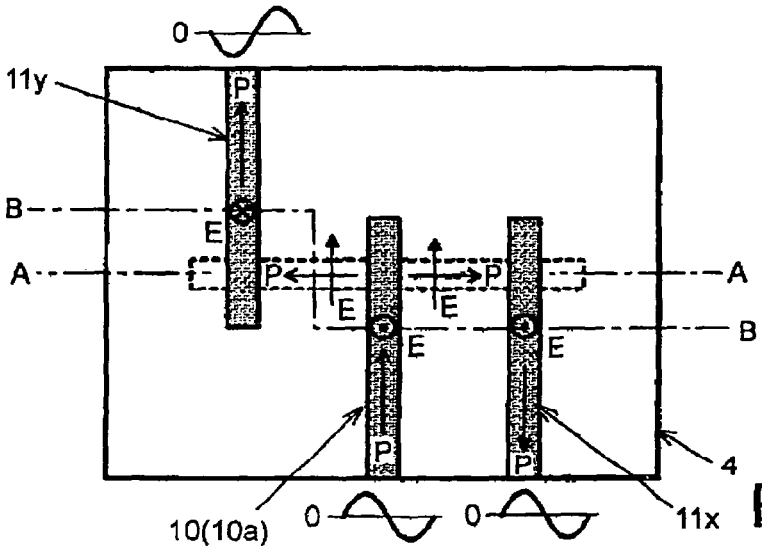
FIG. 7A is a plan view showing a high-frequency balun according to the second embodiment of the present invention.
Figure 7B:
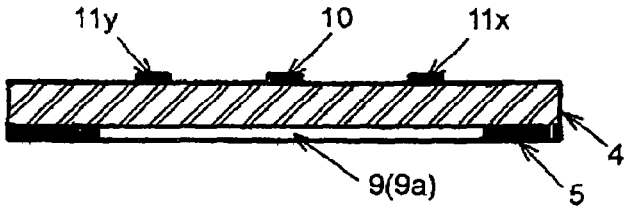
FIG. 7B is a cross-sectional view taken along line A-A in FIG. 7A.
Figure 7C:
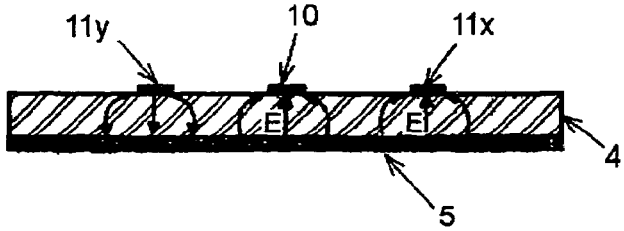
FIG. 7C is a view showing an electric filed direction distribution in the balun taken along line B-B in FIG. 7A.

Next, explanations are given of a balun according to the second embodiment of the present invention with reference to FIGS. 7A to 7*c*. In FIGS. 7A to 7*c*, the same reference numerals are applied to the same elements as FIGS. 4A and 4B.

In the balun according to the first embodiment, one balanced microstrip line 11 is arranged and high-frequency wave components in opposite-phase each other are obtained from both ends of balanced microstrip line 11, whereby the high-frequency component in balanced mode is obtained. However, in the balun according to the second embodiment, a pair, namely, two balanced microstrip lines 11*x*, 11*y* are arranged, both balanced microstrip lines 11*x*, 11*y* are used as a balanced transmission line as a whole, and a high-frequency component in balanced mode is obtained.

In the balun according to the second embodiment, the other end portion of unbalanced microstrip line 10 traverses or crosses the center portion (center point) of slot line 9 that extends in the horizontal direction in drawings, the wavelength corresponding to transmission frequency $f_0$ is set to λ, and the tip of unbalanced microstrip line 10 projects from this traversing point by the electric length of λ/4. Then, balanced microstrip lines 11*x*, 11*y* respectively traverse both end portions of slot line 9. More specifically, microstrip line 11*x* at the right side in drawings extends from the lower end of substrate 4, and traverses slot line 9, and the tip portion projects from this traversing point by λ/4 in electric length. Similarly, microstrip line 11*y* at the left side in drawings extends from the upper end of substrate 4, and traverses slot line 9, and the Up portion projects from this intersection by the electric length of λ/4. In this case, it is assumed that electric line lengths of balanced microstrip lines 11*x*, 11*y* from the lower end and the upper end to the point traversing slot line 9 are equal. Both ends of slot line 9 respectively project from the traversing points of corresponding balanced microstrip lines 11*x*, 11*y* by λ/4 in electric length.

In a balun like this, the high-frequency component applied to unbalanced microstrip line 10 is branched in phase toward both ends of slot line 9 from the traversing point of slot line 9, as a so-called opposite-phase parallel branched structure. In other words, when electric field E is upward from ground conductor 5 to signal line 10*a* of unbalanced microstrip line 10, electric field E that crosses slot line 9 from the lower side to the upper side of slot line 9 and a magnetic field that is orthogonal to the electric field are generated at both right and left sides of unbalanced microstrip line 10. With these electric and magnetic fields, the high-frequency component in balanced mode travels from the center point (i.e., traversing point) of slot line 9 to both ends of slot line 9 in phase.

Then, the high-frequency wave component traveling from the center point of slot line 9 for conversion to both end sides thereof in balanced mode in phase is converted into unbalanced mode by electromagnetic coupling with balanced microstrip lines 11*x*, 11*y* that traverse slot line 9 at both end portions of slot line 9, respectively. For example, in balanced microstrip line 11*x* at the right side, upward electric field E from the other main surface to one main surface of substrate 4 is generated by the electric field distribution that crosses slot line 9. Also, in balanced microstrip line 11*y* at the left side, downward electric field E from one main surface to the other main surface of substrate 4 is generated.

Therefore, with mutually-opposed electric fields E and the magnetic fields due to the electric fields, the high-frequency wave component travels in each of balanced microstrip lines 11$x$, 11$y$ in balanced mode in opposite-phases each other. However, the propagation mode in itself in each microstrip line 11$x$, 11$y$ is in unbalanced mode by the microstrip line. With this arrangement, at output ends of balanced microstrip lines 11$x$, 11$y$, high-frequency wave components in balanced mode in opposite phase each other, using the ground potential as a reference, can be obtained.

Third Embodiment

Figure 8:
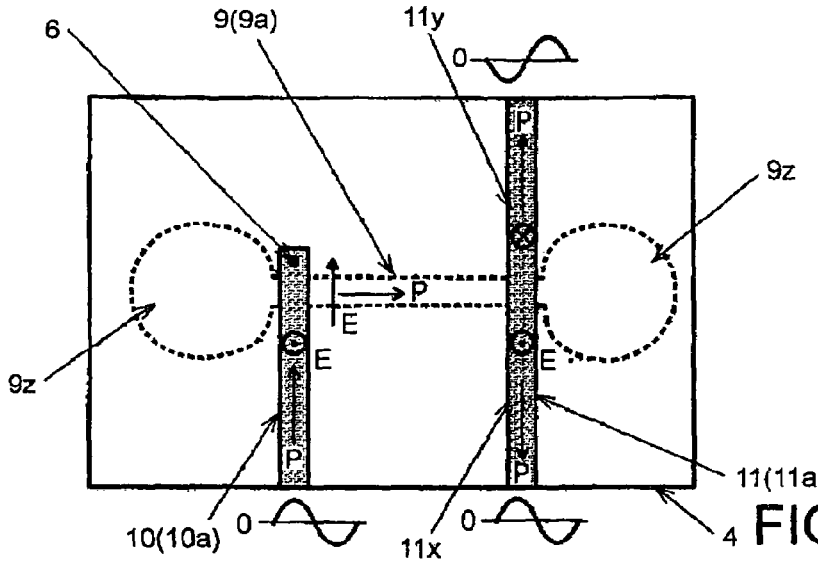
FIG. 8 is a plan view showing a high-frequency balun according to the third embodiment of the present invention.

A balun according to the third embodiment of the present invention shown in FIG. 8 is similar to that of the first embodiment, however, the balun according to the third embodiment is different from that of the first embodiment in an arrangement for setting the tip portion of unbalanced microstrip line 10 to an electrical short-circuited end and an arrangement for setting both ends of slot line 9 to electric open ends.

In the third embodiment, the tip end of unbalanced microstrip line 10 projects from the traversing point of slot line 9 is connected to ground conductor 5 by via-hole 6 that is arranged adjacently to the traversing point. Also, both ends of slot line 9 that project from the traversing points of unbalanced microstrip line 10 and balanced microstrip line 11 are formed so as to be wider than the width of slot line 9 in the portion between these two traversing points, that is, the width of aperture line 9*a* in ground conductor 5. In this embodiment, both ends of slot line 9 are hollows 9*z* as circular openings arranged in ground conductor 5.

According to this arrangement, since both end portions of slot line 9 are respectively in expanded circular shapes, both ends of slot line 9 function as electric open ends not only for the frequency based on the electric length ($\lambda/4$), as an aperture line, but also for a wideband of frequencies. Also, since the tip end of unbalanced microstrip line 10 is connected to ground conductor 5 by via-hole, that is electrode through connection 6, the tip end functions as an electric short-circuited end not only for the frequency based on the line length, but also for a wideband of frequencies.

Therefore, the balun of the third embodiment provides no frequency selectivity, that is, no resonance characteristic in comparison with the balun according to the first embodiment in which the electric open end and the electric short-circuited end are made by using the one-fourth wavelength line. This balun according to the third embodiment provides the flat frequency propagation characteristic and is more suitable to use in a wider band.

In the balun of the second embodiment, an electric short-circuited end can be configured by the via-hole arranged in the tip portion of the microstrip line, and an electric open ends can be configured by hollows formed at end portions of the slot line. Incidentally, when no wide band characteristic is required in particular, the arrangements of the first and second embodiments can be manufactured easily than the arrangement of the third embodiment, because no via-hole is required.

Fourth Embodiment

Figure 9A:
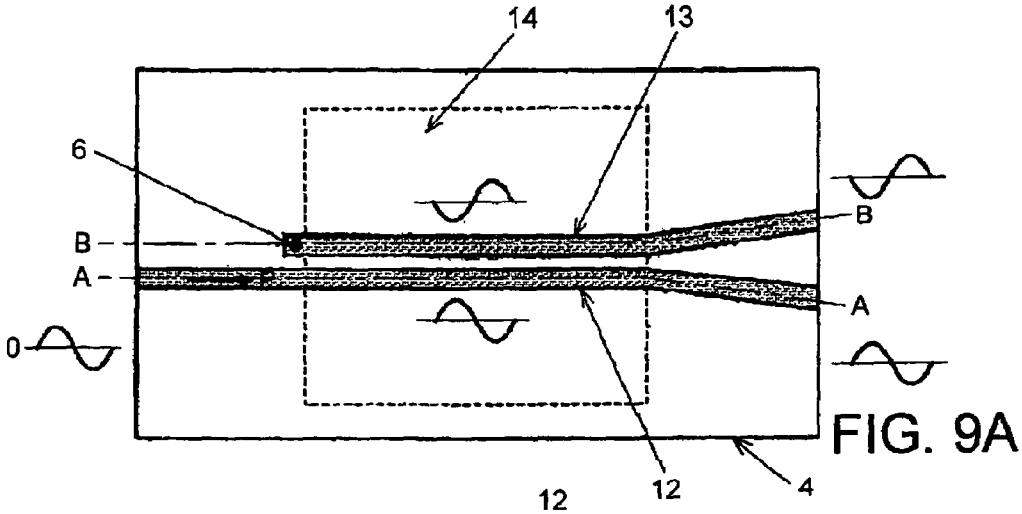
FIG. 9A is a plan view showing a high-frequency balun according to the fourth embodiment of the present invention.
Figure 9B:
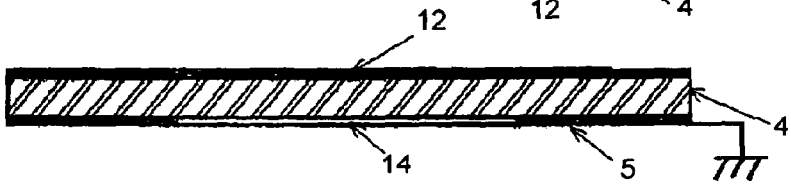
FIG. 9B is a cross-sectional view taken along line A-A in FIG. 9A.
Figure 9C:
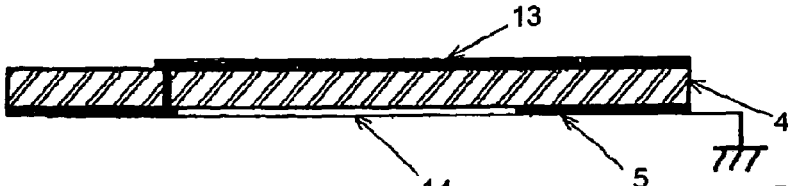
FIG. 9C is a cross-sectional view taken along line B-B in FIG. 9A.

A balun according to the fourth embodiment of the present invention shown in FIGS. 9A to 9C is provided with substrate 4 made of a dielectric material, first and second signal lines 12, 13 arranged in one main surface of substrate 4, and ground conductor 5 arranged in the other main surface of substrate 4. The center area of ground conductor 5 is opening 14, and the other main surface of substrate 4 is exposed in opening 14.

First and second signal lines 12, 13 extend in the horizontal direction in drawings and traverse or cross opening 14 of the other main surface across substrate 4. All areas of both end portions of first and second signal lines 12, 13 are superimposed on ground conductor 5 across substrate 4. Here, first signal line 12 extends from the left end to the right end of substrate 4 and second signal line 13 extends to the right end of substrate from the front position of opening 14 apart from the left end of substrate 44.

First and second signal lines 12, 13 are arranged in parallel to be mutually close above opening 14 and are arranged to be mutually apart in a V-shape from the right end of opening 14 toward the right end of substrate 4. With this arrangement, first signal line 12 provides a microstrip line in the area except the position of opening 14, that is, both end areas that are superimposed on ground conductor 5, and second signal line 13 provides a microstrip line in the area from the right end of the opening to the right end of the substrate. The left end of second signal line 13 is electrically connected to ground conductor 5 in the other main surface of substrate 4 by via-hole 6.

According to this arrangement, for example, at the left end side of substrate 4, a core (center conductor) of the coaxial cable is connected to first signal line 12 and a braided line (outer conductor) is connected to ground conductor 5, thereby applying the high-frequency component in unbalanced mode of transmission frequency $f_0$ to the balun. The high-frequency component in unbalanced mode travels toward the left side of opening 14 by the microstrip line formed by first signal line 12 and ground conductor 5 while unbalanced mode is kept. Then, the high-frequency wave component in unbalanced mode by the microstrip line does not travel any more, because no ground conductor 5 exists within opening 14.

Figure 10A:
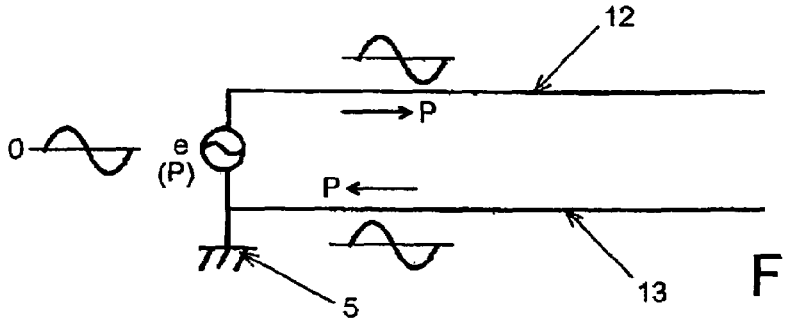
FIGS. 10A and 10B are electric equivalent circuit diagrams for explaining the operation of the balun shown in FIGS. 9A to 9C.
Figure 10B:
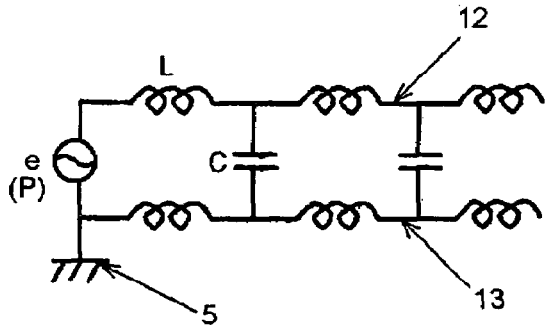

Here, second signal line 13 is connected to ground conductor 6 by via-hole 6 at the left end of second signal line 13 and is arranged in parallel with first signal line 12 above opening 14. Because ground conductor 5 is common to first and second signal lines 12, 13 at the left end of opening 14, as indicated by an electrical equivalent circuit in FIG. 10A, high-frequency wave component P that travels in first signal line 12 as the microstrip line is electromagnetically coupled to second signal line 13 and functions as high-frequency source e that are connected to both signal lines 12, 13 in appearance. In this case, while the left end of second signal line 13 is connected to ground conductor 5 by via-hole 6, second signal line 13 has inductance L for a high-frequency component, because of a strip line (thin line). Also, since first signal line 12 and second signal line 13 are adjacently arranged in parallel, line-to-line capacitance C is generated. Therefore, the transmission line by first signal line 12 and second signal line 13 provides a distributed constant circuit, as shown in FIG. 10B.

For this reason, the potential of second signal line 13 does not become the ground potential by ground conductor 5 with respect to the high-frequency component. Accordingly, high-frequency component P is transmitted on first signal line 12. However, the resistance in the distributed constant circuit is basically 0 with respect to a direct current component, the potential of the first signal line becomes the ground potential. Charges that have electrically opposite signs one other by electrostatic coupling (i.e., capacitive coupling) are generated between first signal line 12 and second signal line 13, and electromagnetic fields having mutually opposite directions are generated between first signal line 12 and second signal line 13. Therefore, high-frequency components in opposite-phase each other travel in first signal line 12 and second signal line 13 from high-frequency source e.

First signal line 12 and second signal line 13 extend in directions that are mutually apart, in the right end from opening 14 and are arranged to be superimposed on ground conductor 5 of the other main surface of substrate 4. Here, while electromagnetic coupling between first signal line 12 and second signal line 13 is gradually released, first signal line 12 and second signal line 13 provide each microstrip line together with ground conductor 5 of the other main surface. The high-frequency component that is transmitted in opposite-phase each other between first and second signal lines 12, 13 transmits through each microstrip line between first and second signal lines 12, 13 as the balanced mode that maintains the mutually-opposite-phase relationship. The high-frequency wave component that transmits through each microstrip line is in unbalanced in itself.

According to this arrangement, with electromagnetic coupling between first signal line 12 and second signal line 13 above opening 14, unbalanced mode of the microstrip line by first signal line 12 is converted into balanced mode, and this functions as a balun. In this case, since this conversion does not use the resonance phenomenon like the conventional balun, it is possible to obtain the balun that provides a relatively flat frequency propagation characteristic and can be used in a wide band.

Figure 11:
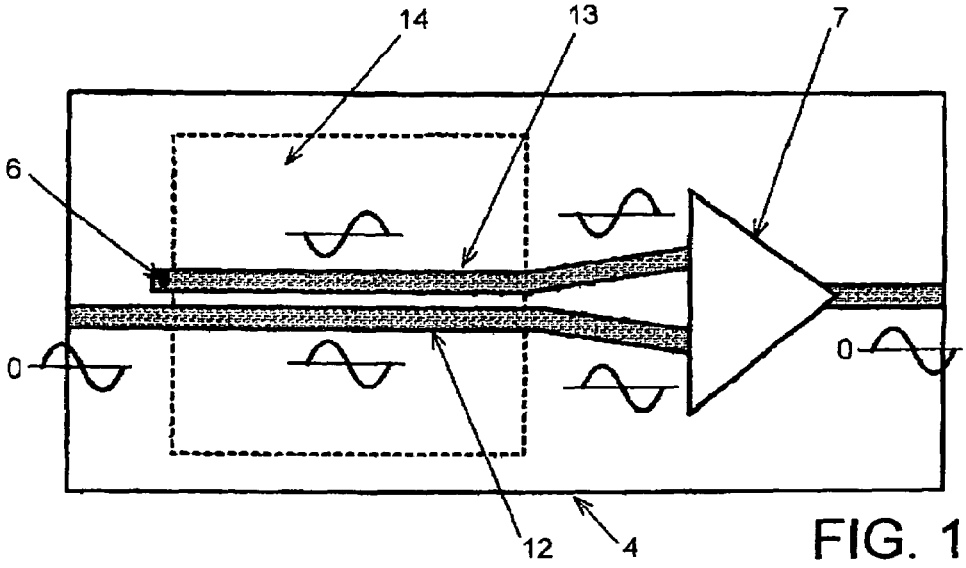
FIG. 11 is plan view showing an application example of the balun shown in FIGS. 9A to 9C.

In the balun according to the fourth embodiment, first signal line 12 and second signal line 13 provide microstrip lines together with the ground conductor 5 of the other main surface of substrate 4 in the area from the right end portion of opening 14 to the right end of substrate 4. Therefore, similarly to the first embodiment, for example, as shown in FIG. 11, balanced input to two-input amplifier 7 arranged on substrate 4 can be carried out easily. In other words, though amplifier 7 is provided with a power source terminal and a ground terminal in addition to input/output terminals, the ground terminal can be connected to ground conductor 5 by a via-hole or the like, and therefore, balanced input of high-frequency components can be carried out easily. On the other hand, when no ground conductor is arranged in the other main surface of substrate 4, it becomes difficult to connect a ground terminal of amplifier 7 to a ground potential point.

Incidentally, even if no ground conductor is arranged in the other main surface of substrate 4 and only first and second signal lines 12, 13 are arranged in one main surface of substrate 4, the mutual-conversion function from unbalanced mode to balanced mode and vice versa is attained. Therefore, a coaxial cable is connected to the microstrip line by first signal line 12 on the left side of substrate 4 and balanced cables are connected to first and second signal lines 12, 13 on the other side, thereby functioning as a two-way high-frequency balun.

What is claimed is:

1. A balun for mutually converting an unbalanced line for unbalanced input/output and a balanced line for balanced input/output, wherein said unbalanced line and said balanced line are microstrip lines including a signal line arranged on one main surface of a substrate and a ground conductor arranged on the other surface of the substrate; comprising:

a slot line formed by an aperture line arranged in said ground conductor in the other main surface of said substrate;

wherein a microstrip line as said unbalanced line includes a first end portion used as an input/output end and a second end portion that traverses said slot line, electromagnetically couples to said slot line, and functions as an electric short-circuited end; and wherein a center portion of a microstrip line as said balanced line traverses said slot line and electromagnetically couples to said slot line and both end portions of said microstrip line as said balanced line are used as input/output ends.

2. The balun according to claim 1, wherein said second end portion of the microstrip line as said unbalanced line traverses said slot line at one end side of the slot line, and the center portion of the microstrip line as said balanced line traverses said slot line at the other end side of the slot line.

3. The balun according to claim 1, wherein in the end portion that functions as said electric short-circuited end of said microstrip line, the signal line and the ground conductor of said microstrip line are electrically connected by an electrode through connection.

4. The balun according to claim 1, wherein both end portion sides of said slot line function as electric open ends.

5. The balun according to claim 4, wherein, viewed from respective traversing points to said microstrip lines, both end portions of said slot line are provided with broader hollows than a width of said slot line at a center portion of said slot line.

* * * * *